US007992265B2

(12) United States Patent
Suenaga

(10) Patent No.: US 7,992,265 B2
(45) Date of Patent: Aug. 9, 2011

(54) FASTENING APPARATUS USING MAGNETISM

(76) Inventor: Takashi Suenaga, Tokyo (JP)

( * ) Notice: Subject to any disclaimer, the term of this patent is extended or adjusted under 35 U.S.C. 154(b) by 532 days.

(21) Appl. No.: 12/216,506

(22) Filed: Jul. 7, 2008

(65) Prior Publication Data

US 2009/0193629 A1 Aug. 6, 2009

(30) Foreign Application Priority Data

Jan. 31, 2008 (JP) ..... 2008-020228
May 7, 2008 (JP) ..... 2008-120936

(51) Int. Cl.
*B42F 1/00* (2006.01)

(52) U.S. Cl. ..... 24/303; 248/309.4; 248/206.5

(58) Field of Classification Search ..... 24/303; 40/124.04; 248/206.5, 309.4, 683; 335/285, 335/302, 303, 306; 600/15
See application file for complete search history.

(56) References Cited

U.S. PATENT DOCUMENTS

| | | | | |
|---|---|---|---|---|
| 4,162,672 | A * | 7/1979 | Yazaki | 600/15 |
| 6,305,656 | B1 * | 10/2001 | Wemyss | 248/309.4 |
| 6,572,945 | B2 | 6/2003 | Bries et al. | |
| 7,220,158 | B1 | 5/2007 | Norris | |

FOREIGN PATENT DOCUMENTS

| | | |
|---|---|---|
| JP | A-05-271628 | 10/1993 |
| JP | A-2002-12629 | 1/2002 |
| JP | A-2002-91319 | 3/2002 |
| JP | A-2003-89778 | 3/2003 |
| JP | A-2005-53213 | 3/2005 |
| JP | A-2007-243022 | 9/2007 |

OTHER PUBLICATIONS

Kitazaki et al., "To Learn Adhesive Agent from Beginning," *K Book Series*, 164, 2001, pp. 122-125, Japan [partial translation].

* cited by examiner

*Primary Examiner* — James R Brittain

(74) *Attorney, Agent, or Firm* — Oliff & Berridge, PLC

(57) ABSTRACT

A fastening apparatus using magnetism enables to fasten an object with a magnetic material to a target surface. The apparatus has a substrate which is flexible and provided at its reverse side with a sticking coat for removably attaching to the target surface, and a magnet receiving hole surrounded by the sticking coat penetrating through the substrate; a flat magnet housed into the magnet receiving hole; an outer film which is fixed on the substrate for separating the flat magnet and the object. The flat magnet is able to be removed out from the magnet receiving hole.

6 Claims, 6 Drawing Sheets

FASTENING APPARATUS USING MAGNETISM

BACKGROUND

This invention relates to a fastening apparatus using magnetism, especially a fastening apparatus using magnetism for interposing between an object such as a small article and a target surface to attach the object to the target surface.

For fastening a memo paper on a surface of magnetic substance such as a refrigerator, the memo paper is interposed between the surface and the magnet. By this method, however, a part of memo paper is hidden by the magnet. And also the method cannot be applied to the surface of non-magnetic substance. In this regard, Japanese patent Laid Open No. 2002-091319 (D1) proposes a device for transmitting information including a sticking sheet from the upper end of which a magnet sheet extending upwardly. The sticking sheet has a release paper at its back and a memo pad attached on the sticking sheet. The device is fastened to the magnetic substance's surface by the magnetic sheet, and fastened to the non-magnetic substance's surface by the sticking sheet.

However, this device occupies a relatively large area on a target surface, since the magnetic sheet is extending from the sticking sheet. On the other hands, there is also proposed a magnetic sticking sheet consisting of a magnetic layer and an sticking coat overlapped thereon, such that the sticking coat is attached on non-magnetic substance target surface. A memo paper or a card may be fastened between a magnet and the magnetic sticking sheet.

For example, Japanese patent Laid Open No. 2007-243022 (D2) teaches a magnetic sticking tape having a magnet base for attracting a magnetic object, and a glue layer (or sticking coat) laid on the magnetic base for attaching to a target surface.

This tape may be cut into a piece of preferable length. But when several pieces are attached to the same target surface, length of each pieces may become unequal shabbily. On the other hand, the applicant proposes a fastening apparatus having a thin plate of magnetic substance such as iron, a base sheet, and a double-sided sticking tape (Japanese patent Laid Open No. 2005-053213 (D 3). The thin plate is placed on the center of the base sheet which is larger in both length and width directions than the thin plate, and the double-sided sticking tape overlaps on both rear sides of the thin plate and the base sheet.

For easy-removal of an object from the target surface, U.S. Pat. No. 6,572,945 (D4) proposes as shown in FIG. 14 a separable fixing apparatus consisting of a pair of connecting coupling C. Each connecting coupling has an sticking surface A at its front side to which a release paper P is attached and a magnetic surface M at its rear side. The magnetic surface of the couples has magnetically different polarity and face each other to combine.

Furthermore, U.S. Pat. No. 7,220,158 (D5) teaches an exercise apparatus having a magnet with a band for fixing to a user's leg, and a contact patch for attaching to a surfboard. The contact patch has a sticking base plate provided with a metal plate, and a protective layer covering the sticking base plate and the metal plate.

In the fastening apparatus taught by patent document 3, it has small amount of magnetic substance such that attracting force to the object becomes small disadvantageously. This is because the magnetic substance is inserted between the base sheet and the double-sided sticking tape, such that the magnetic substance has to be formed thin. The exercise apparatus taught by the patent document 5 has the same disadvantage, because the metal plate is inserted between the sticking plate and the protective layer.

The separable fixing apparatus taught by the patent document No. 4 has the connecting couples which may separate, having two sticking surfaces for attaching to the target surface and the object after the release papers P are removed. However, this apparatus is not suitable to apply to a small article such as a small bottle for medicine. This is because a part of the sticking surface remains unoccupied by the object and is exposed outside, such that the dust may be collected to the exposed part. Moreover, when the users often buy several sets of the fixing apparatus for using at several places, it is apt to happen that one of the connecting couplings is lost. If the connecting couplings having different polarity at their contact surface are remained, the user may combine them as a new set of fixing apparatus. But if the connecting couplings having the same polarity are remained, it is not possible to utilize them against economical request.

First purpose of the present invention is to provide a fastening apparatus using magnetism, by combining an sticking sheet and magnet in good appearance to exhibit a strong magnetic force for pinpointing the target.

Second purpose of the present invention is to provide a fastening apparatus using magnetism facilitating reuse of the magnet. Third purpose of the present invention is to provide a fastening apparatus using magnetism which is suitable to apply to the small article.

As a first means for solving the problem, the applicant proposes a fastening apparatus using magnetism for fastening an object with a magnetic material to a target surface.

The fastening apparatus consists of two main stratum, one is a substrate which is flexible and provided at its reverse side with a sticking coat, the other is an outer film covering the obverse of the substrate. The substrate is provided with a magnet receiving hole, into which a flat magnet is housed, and the flat magnet is stuck to the outer film. The function of the outer film is to separate the object from the flat magnet, such that the outer film is formed so thin that the object may be attracted by the magnetic force between the object and the flat magnet.

One of the important matter in this invention is that the magnet receiving hole for housing the flat magnet is provided in the substrate. This enables to incorporate the magnet into the fastening apparatus with good appearance. It is possible to increase the force attracting the object by using the magnet with strong magnetism, such as a neodymium magnet.

Another important feature of the present invention is to secure enough sticking force to the target surface to resist the magnetic force between the flat magnet and the object. For this purpose, the magnet receiving hole is surrounded by the sticking coat at the reverse side of the substrate. And the reverse side of the substrate and the corresponding surface of the flat magnet are flash with each other (being on a common level). This is because, if the flat magnet is protruded downward from the reverse side of the substrate, an actual sticking surface reduces in area.

Another important feature of the present invention is that the magnet is capable of bringing out from the substrate. As the fastening apparatus utilizing magnetism is repeatedly attached to and removed from the target surface, the reverse side of the substrate will be dusty and lose the sticking force, such that the fastening apparatus is out of use finally. However, the magnet is relatively expensive, it is economical to withdraw it and reuse again. Moreover, there is a strong demand for segregated disposal, such that it is desirable to separate the substrate and the outer film from the magnet and discard them selectively.

Further, another important feature of the present invention is that the substrate is made of flexible material such that it is easy to push the flat magnet out from the magnet receiving hole.

In this invention, the fastening apparatus may also be used as a sticker.

The substrate may desirably be thick and made of soft material, such that it is easy to pick up when attaching to and removing from the target surface.

The magnet receiving hole is separated from at least one side (side portion) of the substrate, such that it is able to pick the fastening apparatus at the one side.

The outer film functions to separate the object from the flat magnet. In this regard, it is desirable to make the outer film as thin as possible by making the outer film of material which is damage-resistant than the substrate. Due to this, the magnetic force between the flat magnet and the object is increased. In comparison, if the outer film is omitted from the construction of the present invention, and the substrate is provided with a recess for housing the flat magnet, it is difficult to form the bottom of the recess thin to guarantee enough strength. It is desirable that the thickness of the outer film is so thin that the object having at least magnetism equal to the flat magnet is attracted to the flat magnet through the outer film. The outer film and the substrate are fixed each other preferably by a pressure sensitive adhesive agent which does not lose viscoelasticity as the time goes by. But the flat magnet and the outer film may be fixed each other by a adhesive agent which is going to be solidified.

The flat magnet is exposed to the outside when the fastening apparatus is attached to the target surface, such that the flat magnet can be easily brought out at the time of disposal. However, the present invention includes an fastening apparatus with the sticking coat being protected by a release paper while they are on distribution channel.

In this specification, the target surface may be any fixed surface such as surfaces of the wall and the furniture, which are suitable for fastening the object.

The object may be a magnet or a magnetic substance such as iron. It is to be noted that the object may be a magnet itself. In this case, the object may be a stopper for interposing a memo paper or a greeting card between the fastening apparatus and the object as shown in FIG. 5. And moreover, the fasting apparatus according to the present invention may be used as magnet element which is incorporated into an object as shown FIG. 9. Furthermore, the magnet may be attached to the bottom of an article such as a small bottle or a signet as shown in FIG. 10.

A second means for solving the problem includes all feature of the fastening apparatus according to the first means, wherein the outer film is provided at its reverse side with an sticking layer for fixing to the substrate and for removably supporting the flat magnet.

In this means, the sticking layer is formed unremovable from the substrate but removable from the flat magnet. In this regard, the substrate and the flat magnet are made of different material, such that sticking layer is made of sticking agent which shows a larger sticking force against the material of substrate and a smaller sticking force against the material of the flat magnet per unit area respectively. For example, the substrate is foamed resin and the flat magnet is metal respectively, and the sticking agent may be acrylic sticking agent.

A sticking strength between the outer film and the substrate is larger than the magnetic force between the flat magnet and the object when the magnetism of the magnetic substance in the object is equal to that of the flat magnet at least. This feature prevents the outer film from peeling off the substrate when the object is pulled vertically away from the fastening apparatus from the state shown in FIG. 10. By the way, the strength of the sticking force (adhesiveness) are described by three element, i.e. tug which occurs as soon as the object touches to the sticking material, sticking force which occurs upon removal of the object from the sticking force, and collective force by which the sticking layer keeps its shape. In the present invention, the sticking force and the collective force contribute to the strength of the sticking force.

A third means for solving the problem includes all feature of the fastening apparatus according to the second means, and wherein the flat magnet fits into the magnet receiving hole having an inner peripheral face perpendicular to the obverse and reverse sides of the substrate, and a circumferential end of the flat magnet is a vertical face which is able to fit the inner peripheral face inversely.

In this means, as the flat magnet is fitted in the magnet receiving hole, it is possible to utilize whole area of the magnet receiving hole and to increase the density of magnetic flux in the hole. Moreover, when a picture or design is formed on the outer film, it is possible to locate the object at a certain position in the picture, such that an unique design may be formed. Furthermore, it is possible to fit the flat magnet into the magnet receiving hole effectively by a process which is later explained with regard to FIG. 13.

In this means moreover, the inner peripheral face is perpendicular to the obverse and reverse sides of the substrate. Due to this feature, it is possible to reverse and refit the flat magnet into the magnet receiving hole after the flat magnet is taken from the magnet receiving hole. If two flat magnets repels each other at the initial mode, it is useful for users reverse one of the flat magnet such that these magnets attracts each other.

A fourth means for solving the problem includes all feature of the fastening apparatus according to the third means, wherein the inner peripheral face of the magnet receiving hole has a circular profile as seen from a direction normal to the reverse side of the substrate, and the flat magnet is shaped to corresponding circular shape.

If the flat magnet is shaped into a square for example, it is necessary to orient the flat magnet in accordance with the magnet receiving hole when the flat magnet is refit into the magnet receiving hole. It is troublesome for user to do it, especially when the flat magnet is small. The present invention proposes a circular flat magnet and a circular magnet receiving hole for omitting the orientation.

A fifth means for solving the problem includes all feature of the fastening apparatus according to the third means, wherein the substrate and the outer film are capable of being cut by a cutter or scissors.

In this means, it is possible to cut the fastening apparatus in accordance with the shape and size of the target surface by scissors etc, especially when the target surface is small. It is relatively easy to cut the fastening apparatus if it is made of foamed resins, even though the apparatus is thick. It is desirable to cut the fastening apparatus around the magnet such that the magnet is at the center of the remaining piece. It is also desirable to make the outer film transparent or form a mark indicating the position of the magnet such that the fastening apparatus may be cut as being attached to the target surface. In a preferred embodiment shown in FIGS. 9 and 10, first fastening apparatus is cut into a suitable size and attached to the bottom of an small article such as a small container, while second fastening apparatus is attached to a top plate of the disk for example. In this way, the first apparatus is fastened to the desk via the second fastening apparatus. Obverse side of the fastening apparatus is made flat. This is because that these two fastening apparatus are in surface contact with each other to guarantee stable support even if the small article is relatively high as shown.

A sixth means for solving the problem includes all feature of the fastening apparatus according to the first means, wherein a pair of side portions of the substrate extends in longwise direction from the magnet receiving hole and overlapped by a corresponding portion of the outer film, these side portion is so long that each side portion and the corresponding portion of the outer film are defined into a pick-up tab, and the flat magnet is rigid, while the substrate and outer film are soft and foldable in a manner that the magnet receiving hole induce a fold to run there through in widthwise direction of the substrate, when the substrate and the outer film are bent into longwise direction, so that the flat magnet is protruded from the magnet receiving hole which is bent on the fold.

In this means, the flat magnet is unbendable rigid member, while the substrate and the outer film are soft and bendable. As the result, when the substrate is bent at the magnet receiving hole, the flat magnet is inevitably protruded from the curved magnet receiving hole. By staying a user's nail with one side of the flat magnet, the flat magnet is easily removed from the magnet receiving hole. In the present invention, the magnet receiving hole is bored in the substrate, so that the substrate is weak in strength at a line penetrating the magnet receiving hole than another part of the substrate. A fold is induced to form on the line, when the fastening apparatus is bent.

For achieving this feature, it is desirable that the substrate and the outer film are soft enough to facilitate bending of the fastening apparatus. In this regard, preferable material for the substrate is foamed material such as Urethane foam, and preferable material for the outer film is vinyl chloride or polypropylene. It is also important that the outer film has uniform thickness. If the outer film has depression and protrusion like cloth, a fold may run without passing through the magnet receiving hole as shown in FIG. 8. This may result in unfavorable folding.

The word "longwise direction" means a direction in which the fastening apparatus is longer than in its widthwise direction. Due to this, it is easy to pick the side of the fastening apparatus in longwise direction, and a fold is apt to extend in a widthwise direction through the magnet receiving hole. It is preferable to use foamed material such as polyolefinic foam as a bendable material.

Summarizing the features of the present invention, the effect of invention according to the first means is that it can exhibit strong magnetic force without deteriorating in appearance, because the flat magnet is embedded in the magnet receiving hole of the substrate, and the magnet is flush with the substrate to make the actual area of the sticking surface wider. Moreover it is capable of getting out flat magnet to reuse it.

The effect of the invention according to the second means is that the fastening apparatus is easy to manufacture, because a single sticking layer fixes the substrate to the outer film and supports the flat magnet.

The effect of the invention according to the third means is that it is possible to reverse the flat magnet, because the inner peripheral face of the magnet receiving hole is perpendicular to the obverse and reverse sides of the substrate.

The effect of the invention according to the fourth means is that it is not necessary to orient the flat magnet, because the inner peripheral face 12 of the magnet receiving hole 10 has a circular profile as seen from a direction normal to the reverse side of the substrate 4.

The effect of the invention according to the fifth means is that the substrate 4 and the outer film 18 are capable of being cut by a cutter etc to put on the bottom of the small article. Due to this, the bottom functions as the target surface. It is also possible to fasten it to the magnetic surface.

The effect of the invention according to the sixth means is that it is easy to pick out the flat magnet when the substrate 4 is bent. This is because a fold transverses the magnet receiving hole, from which the flat magnet is protruded.

DETAIL DESCRIPTION

Figure 1:
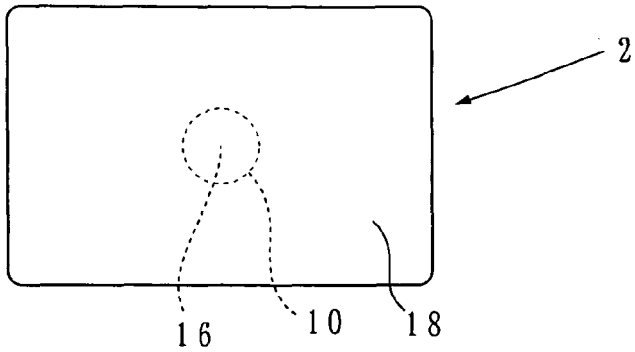
FIG. 1 is a top plan view of a fastening device using magnetism according to the first embodiment of the present invention.

FIGS. 1 to 8 shows a fastening apparatus utilizing magnetism for fixing an object according to first mode of the present invention. The object may be a small article such as a small bottle as shown or a signet.

The fastening apparatus utilizing magnetism comprises a substrate 4, a flat magnet 16, and an outer film 18.

The substrate 4 has a thick laminar-shaped base portion 6 having a magnet receiving hole 10 at its center, and an sticking coat 8 formed at its reverse side of the base portion. The base portion 6 is made of soft and bendable material such as polyolefinic foam for example. The substrate 4 desirably has a thickness of more than 1 mm for embedding a flat magnet therein. It is possible to manufacture the base portion thick with low cost by using foamed material. The sticking coat 8 is capable of being attached to or removed from a target surface repeatedly. The sticking coat 8 is much thinner than the base portion, such that it is expressed in drawing by a thick line. The shown substrate has a rectangular shape but may be formed into is any favorite shape such as polygon or shape of an animal. The magnet receiving hole 10 is circular in plane view and has an inner peripheral face 12 perpendicular to the reverse and obverse sides of the sticking coat 8. The sticking coat 8 is adapted to peel from the target surface for several times. And it is desirable that the sticking coat 8 fits well to an uneven surface such as a cloth material for walls, and it may be formed of urethane pressure sensitive adhesive agent.

Figure 5:
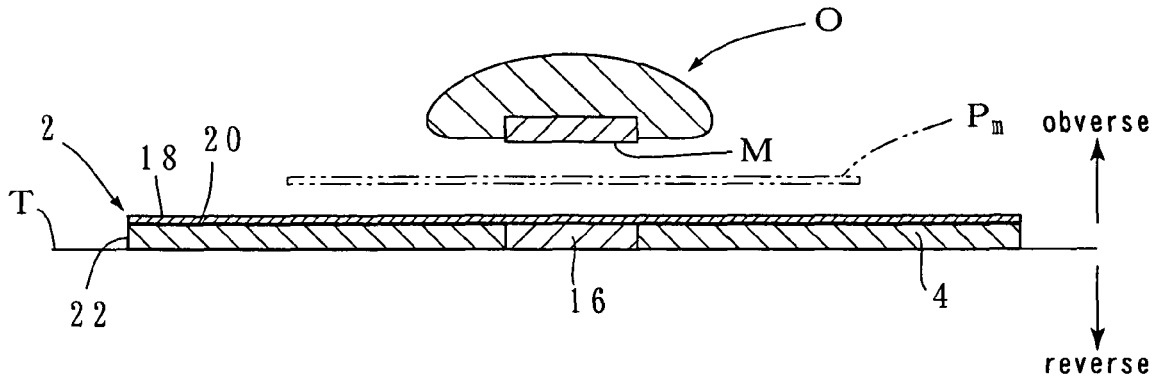
FIG. 5 is a drawing for explaining how to use the fastening device using magnetism of FIG. 1.
Figure 6:
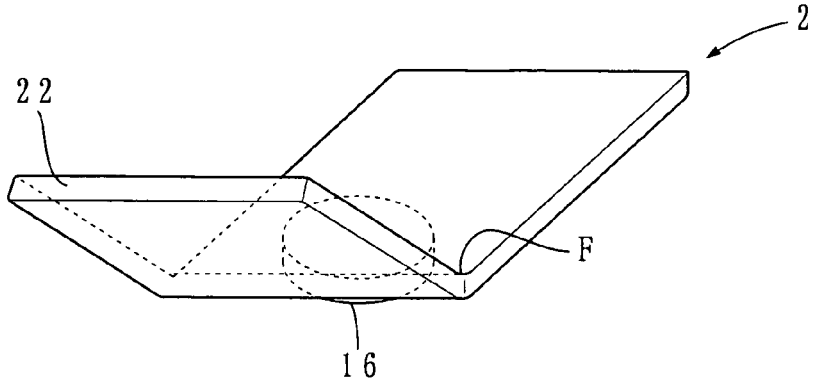
FIG. 6 is an oblique perspective view showing one step of usage of the fastening device using magnetism of FIG. 1.

In this specification, the word "obverse" and "reverse" are used in a way that, in regard to the substrate and the outer film, a direction towards the object is "obverse" and a direction towards the target surface is "reverse" as shown in FIG. 5.

The flat magnet 16 is formed into a thin circular disk having a thickness equal to the substrate 4 fits into the flat magnet. The flat magnet may preferably be strong magnet such as neodymium magnet. In case of neodymium magnet, the magnet of 5 mm in diameter and 1 mm in thickness is large enough to achieve a sufficient strength of magnetism for practical use (of holding meme). In applicant's trial using two magnet of such size, it is possible support six or seven sheets of A4 size paper vertically. All the weight of the flat magnet 16 is supported by a later-described sticking layer. On the other hand, part of the weight me be supported by fitting force of the magnet receiving hole.

The outer film 18 is at least thinner than the substrate 4, and adapted to make as thinner as possible within a range without breaking in repetitive bending. As the outer film being thinner, more stronger the magnetic force is. Preferable material is thin, strong and resistant to breaking, and low magnetic permeability substance (non-magnetic substance). If the magnetic permeability is high, magnetic lines flow along the surface of the outer film so that the attraction force between the magnets is reduced. In the applicant's trial, the outer film has a depth of 60 to 75 micron and is made of polypropylene or vinyl chloride. The both side portions of the substrate 4 and outer film 18 are formed into a pair of pick-up tabs 22.

Figure 4:
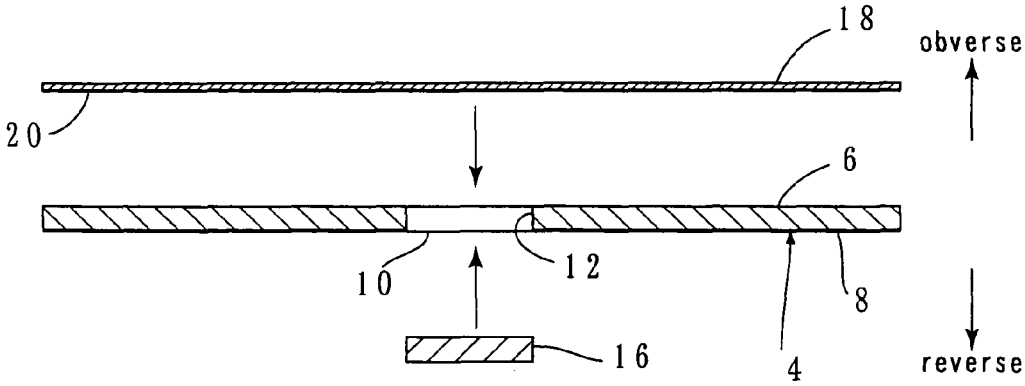
FIG. 4 is a vertical section of the fastening device using magnetism of FIG. 1. in a dissolved manner.

The sticking layer 20 is formed at the reverse side of the outer film 18. More in detail, the sticking layer 20 is formed at the reverse side of the outer film 18 as shown in FIG. 4, and the outer film with sticking layer is placed on the substrate 4. The first role of the sticking layer 20 is that the outer film strongly sticks to the substrate 4 against the attracting force between the flat magnet and the object. The second role of the sticking layer 20 is to removably support the flat magnet 16 to the reverse side of the outer film 18. The acrylic or rubber-type pressure sensitive adhesive agent for adhering to both metal and resin such as polyolefin is widely known such as Japanese Patent Laid Open 2002-012629 and 2003-89778. KITAZAKI Yasuaki and SAITO Tsugio teach in "To Learn Adhesive Agent From Beginning" written by, Industry Search Company, issued on May 20, 2001 that in the case of the acrylic pressure-sensitive adhesive agent, it is possible to improve its sticking force to polyolefins by addition of tackifying resin. By utilizing these techniques, it is possible to produce an pressure-sensitive adhesive agent which shows stronger sticking force to the resin than metal. Moreover, it is possible to apply anchor effect of adhesive agent to the present invention such as Japanese Patent Laid-Open 05-271628. The anchor effect is that the sticking agent permeates into recessions of uneven surface and sticks thereto. In this case, the substrate may be Polyolefin foam having a lot of cavities, into which the pressure-sensitive adhesive agent are permeates for fixing the sticking layer to the substrate. Moreover, it is desirable that the sticking area to the flat magnet is sufficiently larger than the sticking area to the substrate. In applicant's trial, the fastening apparatus utilizing magnetism is 3 cm in length and 2 cm in width. And in this case, the sticking coat is made of solvent-type acrylate pressure-sensitive adhesive.

Figure 2:
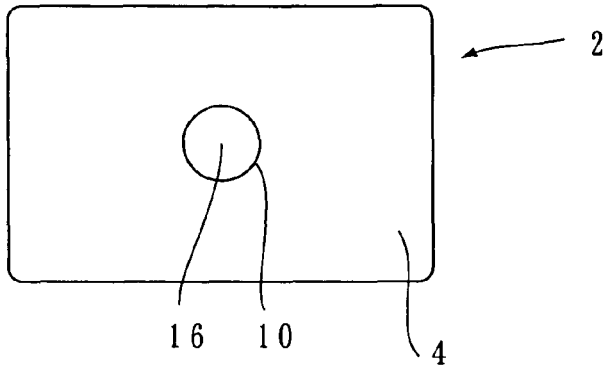
FIG. 2 is a reverse view of the fastening device using magnetism of FIG. 1.

A release paper 24 may be attached to the reverse side of the fastening apparatus 2 as shown with a imaginary line in FIG. 2.

Figure 3:
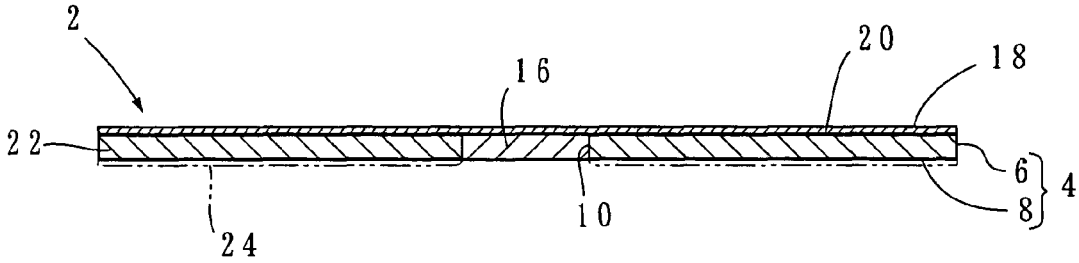
FIG. 3 is a vertical section of the fastening device using magnetism of FIG. 1.

For use, the user peels off the release paper 24 from a state shown in FIG. 3, and may stick the reverse side of fastening apparatus to the target surface T such as surface of furniture. By approaching an object including magnet M to the fastening apparatus utilizing magnetism as shown in FIG. 5, the object is stuck to the surface of the fastening apparatus by attraction force. The object shown in FIG. 5, is a memo holder for holding memo paper Pm shown with imaginary line between the target surface and the object. It is possible to release the memo paper off the target surface T ad the object O by pulling therefrom. Memo paper slides along these surfaces so that the object stays as it is and is fastened at the target surface. When removing the fastening apparatus from the target surface T, the user should pull the pick-up tab 22.

Figure 7:
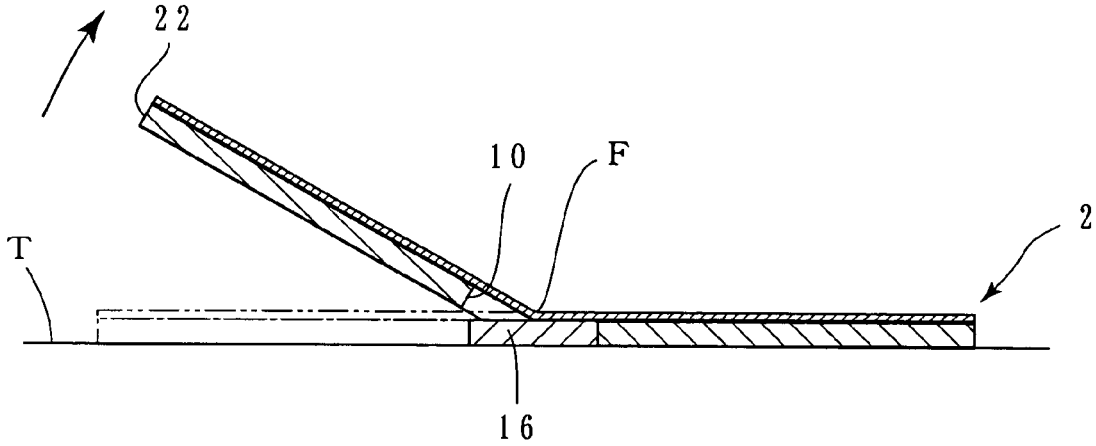
FIG. 7 is a vertical section of the fastening device in one step after the step shown in FIG. 6.
Figure 8:
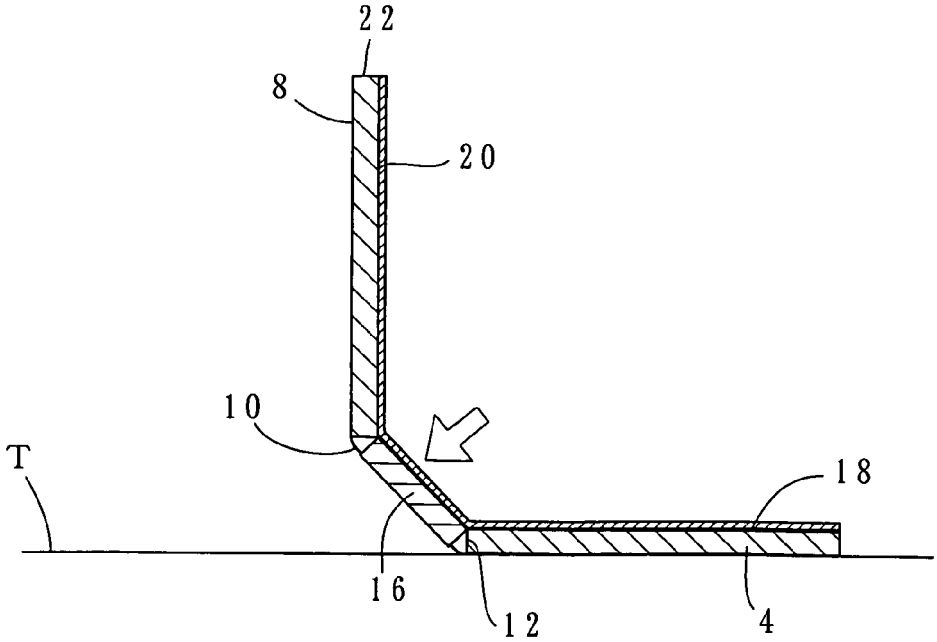
FIG. 8 is a drawing for explaining bad example of usage corresponding to FIG. 7.

The object O shown in FIG. 5 may be ready-made. If the underside of the magnet M and the corresponding side of flat magnet have magnetically homo polarity, the flat magnet should be reverse. User can reverse it by pulling its pick-up tab 22. When the substrate 4 and the outer film 18 are soft sufficiently, the fastening apparatus 2 begins to peel from one end of the fastening apparatus in longitudinal direction, bending at a partition or a fold F as shown in the drawing. And the fold moves to the magnet receiving hole. When the fold reaches to the magnet receiving hole, the outer film 18 separates from the upper side of the flat magnet 16. At the same time, the resistance to the bending becomes smaller, because the actual length of the fold is shorter. As a result, the degree of bending is increased, and the end of the flat magnet is protruded as shown in FIG. 7. The user stays the nail to the end of the flat magnet and pull it from the fastening apparatus. On the other hand, when the outer film is not uniformly soft because of being made of cloth material, the fastening apparatus may be bent at several portions as shown in FIG. 8 in a way that the flat magnet does not protrude from the magnet receiving hole. In such case, the user pushes the fastening apparatus at the opposite side of the magnet receiving hole, so that the fold is formed to transverse the magnet receiving hole from which the flat magnet is protruded. After that, the user can stays the nail to the end of the flat magnet and pull it from the fastening apparatus.

The flat magnet pulled out from the apparatus may be used as a new object. In other preferable embodiment, the magnet may be set at an exchange article. The exchange article is equal to the fastening apparatus but omitting the flat magnet and is on sale for change.

In the aforementioned explanation, the flat magnet is removed from fastening apparatus which sticks to the target surface, but it is possible to peel the fastening apparatus and to remove the flat magnet from the fastening apparatus. When the flat magnet 16 is refit into the magnet receiving hole 10, it can be fitted easily without orientating it. This is because the magnet and hole are circular.

Hereinafter other modes of the present invention are explained. In the explanation, the features common with the first mode is omitted but allotting the same number.

Figure 9:
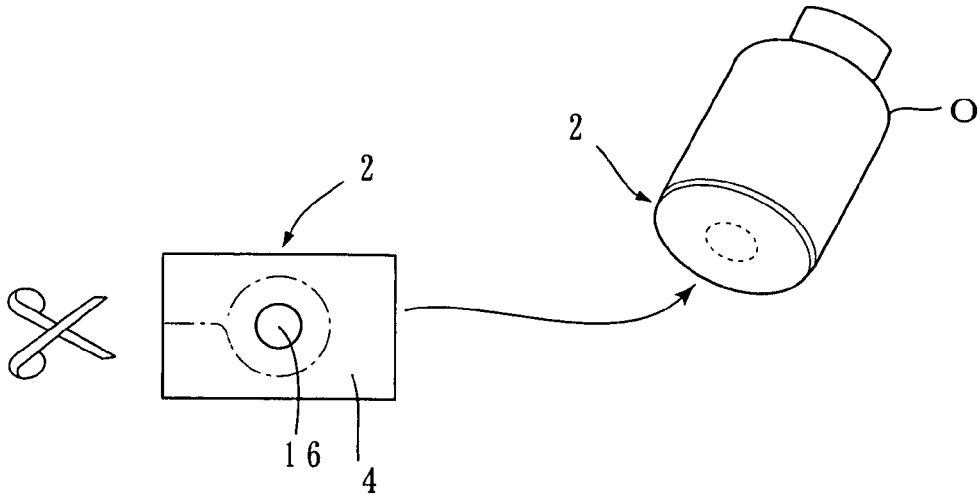
FIG. 9 is a top plan view of a fastening device using magnetism according to the second embodiment of the present invention.
Figure 10:
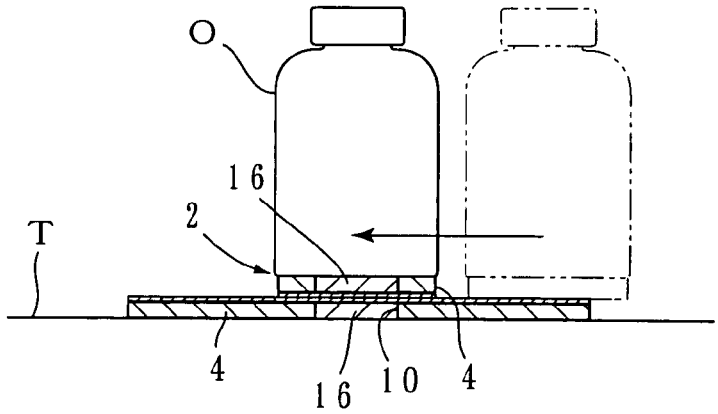
FIG. 10 is a drawing for explaining the action of the fastening device using magnetism of FIG. 9.

FIGS. 9 and 10 show a fastening apparatus utilizing magnetism for fixing an object according to second mode of the present invention. In this mode, the substrate 4 and the outer film 18 are capable of being cut by a cutter or scissors. User cuts the fastening apparatus in accordance with the size and shape of the bottom of the object, that is a small bottle, and stick it to the bottom. It is desirable to cut the fastening apparatus in a way that the flat magnet is at the center of the piece of apparatus as shown in FIG. 9.

At the target surface, on the other hand, another fastening apparatus 2 utilizing magnetism is attached. The small container is set to the target surface by magnetic force between the flat magnets, when approaching the small container to the target surface. In this mode, the flat magnets are equal in their size. Due to this, even if the small container is placed on a position away from the center of the flat magnet, the small container moves to the right position by magnetism.

In each fastening apparatus utilizing magnetism, the flat magnet is surrounded by the substrate 4 and the outer film 18, and the outer film is flat. The two fastening apparatus are in surface contact with each other preventing rattling.

Figure 11:
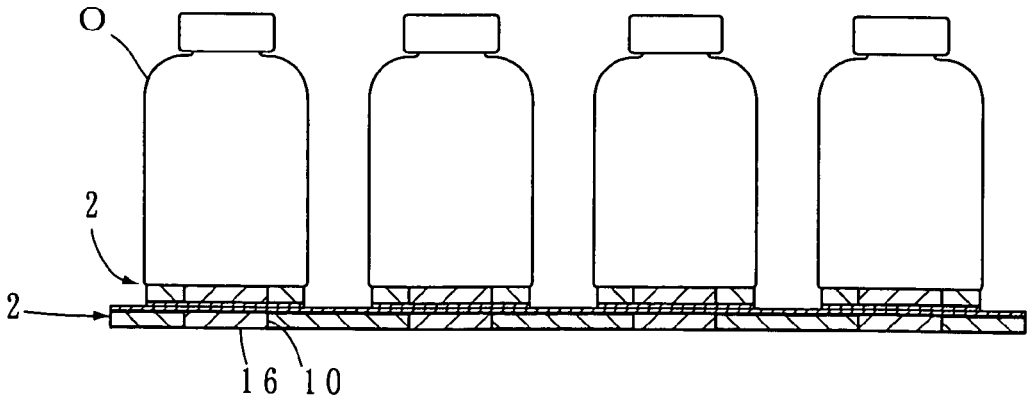
FIG. 11 is a top plan view of a fastening device using magnetism according to the third embodiment of the present invention.

FIG. 11 shows a fastening apparatus utilizing magnetism for fixing an object according to third mode of the present invention.

The fastening apparatus according to this mode is narrower and longer than that in the first mode. And there are arranged several magnet receiving holes 10 in longitudinal direction, in which the flat magnets are fitted respectively. Due to this, several objects may be fastened. It is desirable that the several magnet receiving are arranged at equal intervals. As the object is put in the vicinity of the flat magnet, the object moves to the regular right position by magnetic force. Therefore, it enables to arrange the objects regularly, improving its appearance.

Figure 12:
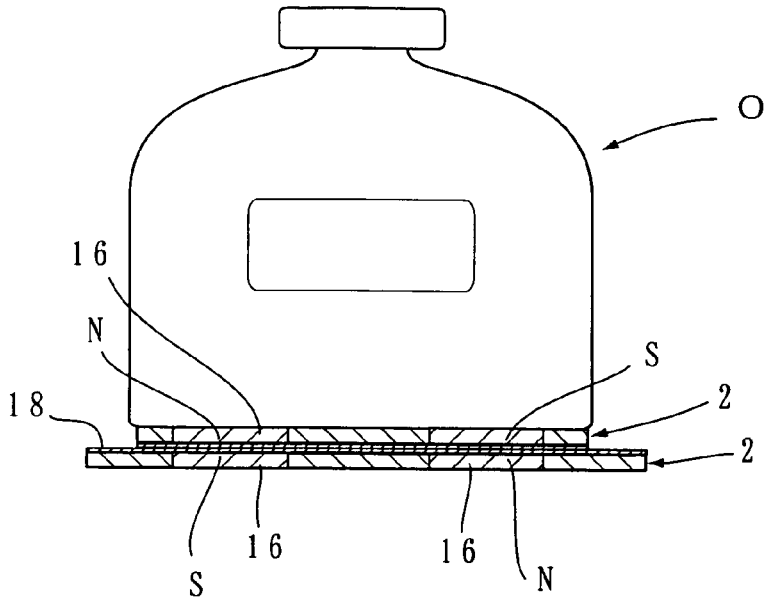
FIG. 12 is a top plan view of a fastening device using magnetism according to the forth embodiment of the present invention.

FIG. 12 shows a fastening apparatus utilizing magnetism for fixing an object according to fourth mode of the present invention. This embodiment is a variation of the second and third embodiment, which proposes a preferable usage of the fastening apparatus using magnetism. This fastening apparatus using magnetism has two magnet receiving holes 10. In one of the two magnet receiving hole, a flat magnet is inserted with its N pole facing outward. In the other of the two magnet receiving hole, a flat magnet is inserted with its S pole facing outward. There are two fastening devices having the same structure, one of which is fastened to the object, the other is fastened to the target surface. These fastening devices meet each other in a manner that each side of different polarity attracts mutually. In this manner, the object always faces to a specific direction. For example, when the object is a container having a label as shown in drawings, the label always faces to the same direction usefully. In the shown embodiment, there are two magnet receiving hole, they may be more than two. For example, three or more magnet receiving holes are formed in equidistant and equiangular manner around a central axis. In one of the fastening device, the flat magnet is inserted in one magnet receiving hole with its N pole outside, and the flat magnets are inserted in other holes with their S pole outside. In the other fastening device, the flat magnets are inserted with its S pole outside in one magnet receiving hole and with its N pole outside in other magnet receiving holes.

Figure 13:
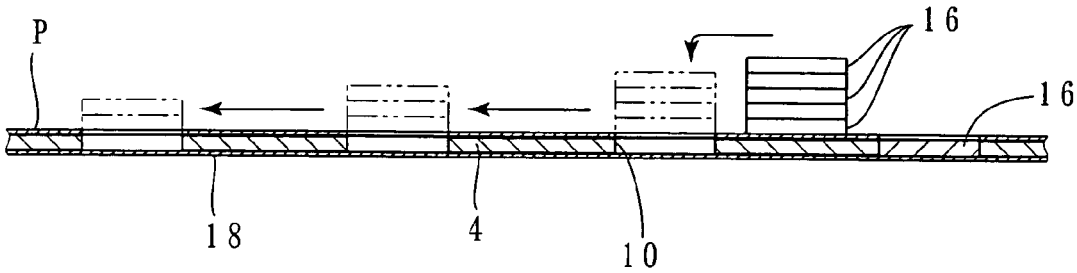
FIG. 13 is a top plan view of a fastening device using magnetism according to the fifth embodiment of the present invention.
Figure 14:
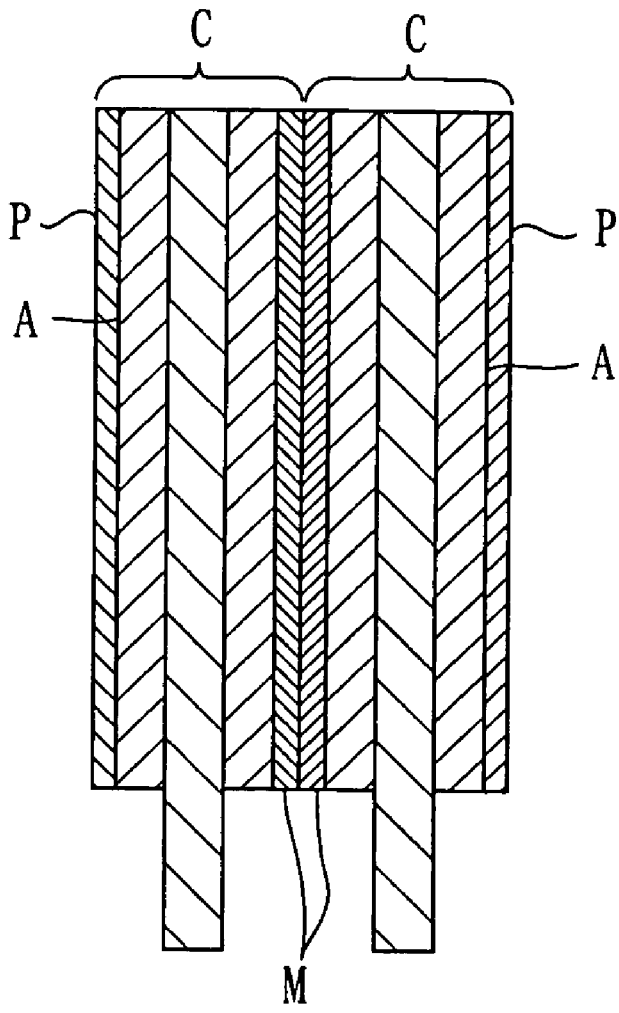
FIG. 14 is a vertical section of prior art magnet-adhesive fastening device.

FIG. 13 shows fifth mode of the present invention which proposes a preferable method of forming a sticking sheet. Magnet receiving holes are provided in a substrate 4 which is formed into a strip. A release paper P for protecting the sticking coat is stuck to the of reverse side of the substrate releasably. The release paper has holes corresponding to the magnet receiving hole and having equal diameter. An outer film 18 is laminated on the obverse side of the substrate.

The substrate and the laminated outer film are reversed. On the other hand, the flat magnets are piled up as shown in drawing. The number of the magnets is equal to that of the magnet receiving holes. As the flat magnets slide on the release paper, the lowest flat magnet is dropped into a first magnet receiving hole. The pile of the flat magnets are moved to advance except the one which is remained in the flat receiving hole. By repeating this process, the flat magnet are fitted in the magnet receiving holes.

The substrate and the outer film are cut between the magnet receiving holes so as to divide into the fastening devices using magnetism according to the present invention. It is desirable that the magnet receiving hole and flat magnet are equal in diameter.

2 . . . fastening apparatus
4 . . . substrate
6 . . . base portion
8 . . . sticking coat
10 . . . magnet receiving hole
12 . . . inner peripheral face
16 . . . flat magnet
18 . . . outer film
20 . . . sticking layer
22 . . . pick-up tab
24 . . . release paper
A . . . adhesive surface
M . . . magnet surface
C . . . connecting coupling
O . . . object
T . . . target surface
F . . . fold
Pm . . . memo paper

We claim:

1. A fastening apparatus using magnetism for removably fastening an object with a magnetic material to a target surface, comprising;

a substrate which is flexible and provided at its reverse side with a sticking coat for removably attaching to the target surface, and a magnet receiving hole surrounded by the sticking coat penetrating through the substrate, a flat magnet housed into the magnet receiving hole an outer film which is fixed on the substrate for separating the flat magnet and the object, wherein the outer film removably sticks the flat magnet, and the flat magnet has a thickness substantially equal to that of the substrate, such that a reverse side of the substrate and a corresponding side of the flat magnet are in a flush manner, and when the fastening apparatus is removed from the target surface, the flat magnet is exposed to outside, such that the flat magnet is able to be removed out from the magnet receiving hole.

2. A fastening apparatus using magnetism according to claim 1, wherein the outer film is provided at its reverse side with an sticking layer for fixing to the substrate and for removably supporting the flat magnet.

3. A fastening apparatus using magnetism according to claim 2, wherein the flat magnet fits into the magnet receiving hole having an inner peripheral face perpendicular to an obverse side and the reverse side of the substrate, and a circumferential end of the flat magnet is a vertical face which is able to fit the inner peripheral face inversely.

4. A fastening apparatus using magnetism according to claim 3, wherein the inner peripheral face of the magnet receiving hole has a circular profile as seen from a direction normal to the reverse side of the substrate, and the flat magnet is shaped to a corresponding circular shape.

5. A fastening apparatus using magnetism according to claim 3, wherein the substrate and the outer film are capable of being cut by a cutter or scissors.

6. A fastening apparatus using magnetism according to claim 1, wherein a pair of side portions of the substrate extends in longwise direction from the magnet receiving hole and overlapped by a corresponding portion of the outer film, these side portion is so long that each side portion and the corresponding portion of the outer film are defined into a pick-up tab, and the flat magnet is rigid, while the substrate and outer film are soft and foldable in a manner that the magnet receiving hole induce a fold to run therethrough in widthwise direction of the substrate, when the substrate and the outer film are bent into longwise direction, so that the flat magnet is protruded from the magnet receiving hole which is bent on the fold.

* * * * *